US010168082B2

(12) United States Patent
Troxell et al.

(10) Patent No.: US 10,168,082 B2
(45) Date of Patent: Jan. 1, 2019

(54) TANDEM COMPRESSOR SLIDE RAIL

(71) Applicant: Lennox Industries Inc., Richardson, TX (US)

(72) Inventors: Marcus Troxell, Frisco, TX (US); Geoffrey Curtis, Plano, TX (US); Miguel Montemayor, Carrollton, TX (US); Harold Gene Havard, Jr., Carrollton, TX (US)

(73) Assignee: LENNOX INDUSTRIES INC., Richardson, TX (US)

( * ) Notice: Subject to any disclaimer, the term of this patent is extended or adjusted under 35 U.S.C. 154(b) by 480 days.

(21) Appl. No.: 14/720,451

(22) Filed: May 22, 2015

(65) Prior Publication Data

US 2015/0338141 A1 Nov. 26, 2015

Related U.S. Application Data

(60) Provisional application No. 62/002,562, filed on May 23, 2014.

(51) Int. Cl.

| | |
|---|---|
| ***F25D 19/00*** | (2006.01) |
| ***F25D 23/00*** | (2006.01) |
| ***F25B 45/00*** | (2006.01) |
| ***F25B 31/00*** | (2006.01) |
| ***F25B 49/02*** | (2006.01) |

(52) U.S. Cl.

CPC ..... *F25B 31/00* (2013.01); *F25B 45/00* (2013.01); *F25B 49/02* (2013.01); *F25D 23/006* (2013.01); *F25B 2400/075* (2013.01); *F25B 2500/13* (2013.01); *F25D 19/00* (2013.01)

(58) Field of Classification Search

CPC ..... F25B 31/00; F25B 45/00; F25B 49/02; F25B 2400/075; F25B 2500/13; F25D 23/006; F25D 19/00

USPC ..... 62/297, 302, 77

See application file for complete search history.

(56) References Cited

U.S. PATENT DOCUMENTS

| | | | | |
|---|---|---|---|---|
| 2,496,751 | A * | 2/1950 | Ritter | B61D 27/0018 62/302 |
| 3,712,078 | A * | 1/1973 | Maynard | F25D 19/00 165/76 |
| 3,866,867 | A * | 2/1975 | LaRocca | F16M 5/00 248/646 |
| 3,956,904 | A | 5/1976 | Edwards | |
| 6,618,487 | B1 | 9/2003 | Azima et al. | |
| 6,772,599 | B2 | 8/2004 | Bodell, II et al. | |
| 6,775,996 | B2 | 8/2004 | Cowans | |
| 7,162,889 | B2 * | 1/2007 | Lee | F24F 1/022 62/298 |
| 8,226,068 | B2 | 7/2012 | Azar et al. | |
| 2003/0095871 | A1 | 5/2003 | Hebert | |
| 2005/0056041 | A1 * | 3/2005 | Jin | F25D 23/006 62/302 |

(Continued)

*Primary Examiner* — Joseph Trpisovsky

(74) *Attorney, Agent, or Firm* — Hubbard Johnston, PLLC

(57) ABSTRACT

A system and method are disclosed for compressor units in HVAC systems. A slide plate and slide rail assembly is described that can allow compressors to be slidably removed or adjusted to allow for easy repair or servicing. Instead of disassembling an entire compressor unit when repairs are needed on it or on neighboring components, the compressor unit can be quickly moved. Dual slide rail and slide plate configurations are described as well.

10 Claims, 9 Drawing Sheets

(56) References Cited

U.S. PATENT DOCUMENTS

| | | | | |
|---|---|---|---|---|
| 2010/0180609 | A1* | 7/2010 | Heitz | F04B 39/14 62/77 |
| 2012/0014627 | A1* | 1/2012 | Rehage | A47B 88/487 384/49 |
| 2012/0035773 | A1 | 2/2012 | Stabinski et al. | |

* cited by examiner

TANDEM COMPRESSOR SLIDE RAIL

CROSS REFERENCE TO RELATED INFORMATION

This application claims the benefit of U.S. Provisional Patent Application No. 62/002,562, filed May 23, 2014, the contents of which are hereby incorporated herein in its entirety.

TECHNICAL FIELD

The present disclosure is directed to HVAC systems and components and in particular to a slide rail that allows for dual compressor configurations.

BACKGROUND OF THE INVENTION

HVAC systems contain numerous components such as compressors, heating coils, cooling coils, fans, heat sinks, and more. At times, these various components must be made to fit into small footprints or oddly shaped footprints. A difficulty can arise in how to arrange and fit all the necessary components into the allowable space. Once an HVAC system is installed another difficulty arises when servicing and repair is needed. If many components have been squeezed into a small area, then accessing a broken part can be difficult. Numerous components may need to be removed so that a repairman can access all the areas that need servicing.

Many HVAC systems utilize a tandem compressor arrangement. Tandem compressors can provide advantages by compressing more fluid than a single compressor. Often a single line carries fluid to the compressors, the line splits and carries fluid to both compressors, and then after the compressors the lines converge back into one line. Tandem compressors can be placed in close proximity and the inlets/outlets for each compressor can be connected to the entry/exit lines by brazing joints or other connections. When servicing is required on the compressors or behind the compressors, the joints under and above the compressors connecting the fluid lines are detached and the compressors are removed. However, removing the compressors can be cumbersome. There is often an oil connection between the tandem compressors. Because the compressors share oil they can be difficult to move separately.

BRIEF SUMMARY OF THE INVENTION

One embodiment of the present teachings is an HVAC system comprising: a slide rail mounted to the HVAC system; a plurality of compressors fluidly coupled to at least one other component within the HVAC system; and a slide plate, the slide plate comprising attachments to the plurality of compressors and comprising a slidable attachment to the slide rail, the slide plate further comprising a locking attachment operable to lock the slide plate in position with respect to the slide rail.

Another embodiment of the present disclosure comprises an HVAC slide rail system comprising: a slide rail; and a slide plate, the slide plate slidably attached to the slide rail, the slide plate comprising a plurality of attachment mechanisms operable to attach to a plurality of compressors, the plurality of compressors operable to compress fluid in an HVAC system.

Another embodiment of the present disclosure comprises a method of constructing an HVAC system comprising: connecting a suction line to a plurality of compressors; attaching each of the plurality of compressors to a slide plate; slidably attaching the slide plate to a slide rail; and providing a discharge line from the plurality of compressors.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
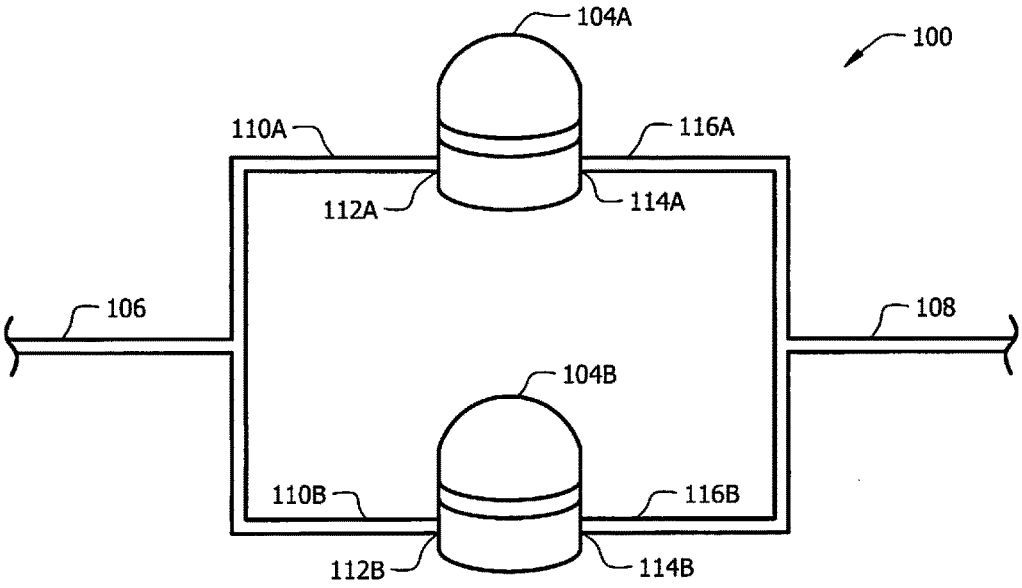
FIG. 1 is a diagram of a tandem compressor configuration.

Some heating, ventilation, and air conditioning (HVAC) systems utilize a tandem compressor arrangement. Compressors configured for tandem operation are shown in FIG. 1. Tandem compressors may share common refrigerant piping. Specifically, the suction line for each compressor forks off from a single, common suction line and the discharge lines coming off each compressor are merged into a single, common discharge line.

The compressor section of an HVAC system 100 utilizing a tandem compressor arrangement is shown in FIG. 1. HVAC system 100 may include compressors 104A and 104B. The compressors may be connected to common suction line 108 via suction ports 114A and 114B, respectively, which may be brazed to legs 116A and 116B of the split suction line 108. The compressors may also be connected to common discharge line 106 via discharge ports 112A and 112B, respectively, which may be brazed to legs 110A and 110B of common discharge line 106.

The tandem compressor arrangement allows for efficient HVAC system operation by providing greater ability to match partial load demands on the HVAC system while still allowing for high overall system capacity during full load operation. One disadvantage of the tandem compressor arrangement is that the shared piping among the tandem compressors may make removing or accessing the compressors for maintenance exceedingly difficult. A slide rail apparatus is presented for ease of access to, and removal of, compressors configured to operate as tandem compressors.

Figure 2:
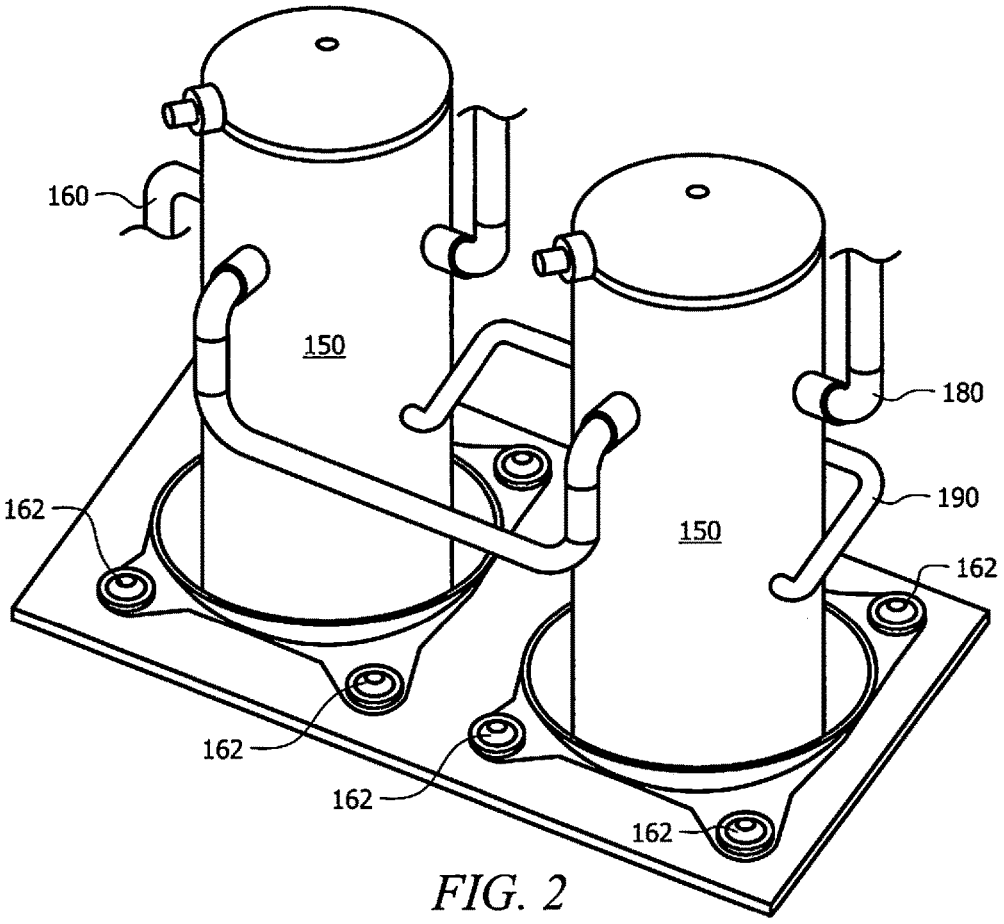
FIG. 2 is a diagram of a prior art tandem compressor configuration.

FIG. 2 shows a prior art tandem compressor embodiment. Compressors 150 are connected by suction line 160 which can provide fluid to the compressors 150. Discharge line 180 can draw fluid away. Compressors 150 are typically hard mounted to a common plate 175, and then attached to the HVAC unit on rubber grommets 162. Attachment mechanisms can include screws, bolts or other means. As seen in FIG. 2, if compressors 150 must be serviced, or moved in order to service another HVAC component located behind the compressors 150, the process can be quite difficult. Plate 175 may be bolted or otherwise connected to the ground or base of an HVAC system. But detaching the plate only means a user has to pull the whole contraption out of the system. The compressors can be detached separately, but that will take a lot of time and adjustment/cutting of suction and discharge lines 160, 180. Oil connection 190 may need to be cut, causing loss of oil.

Figure 3:
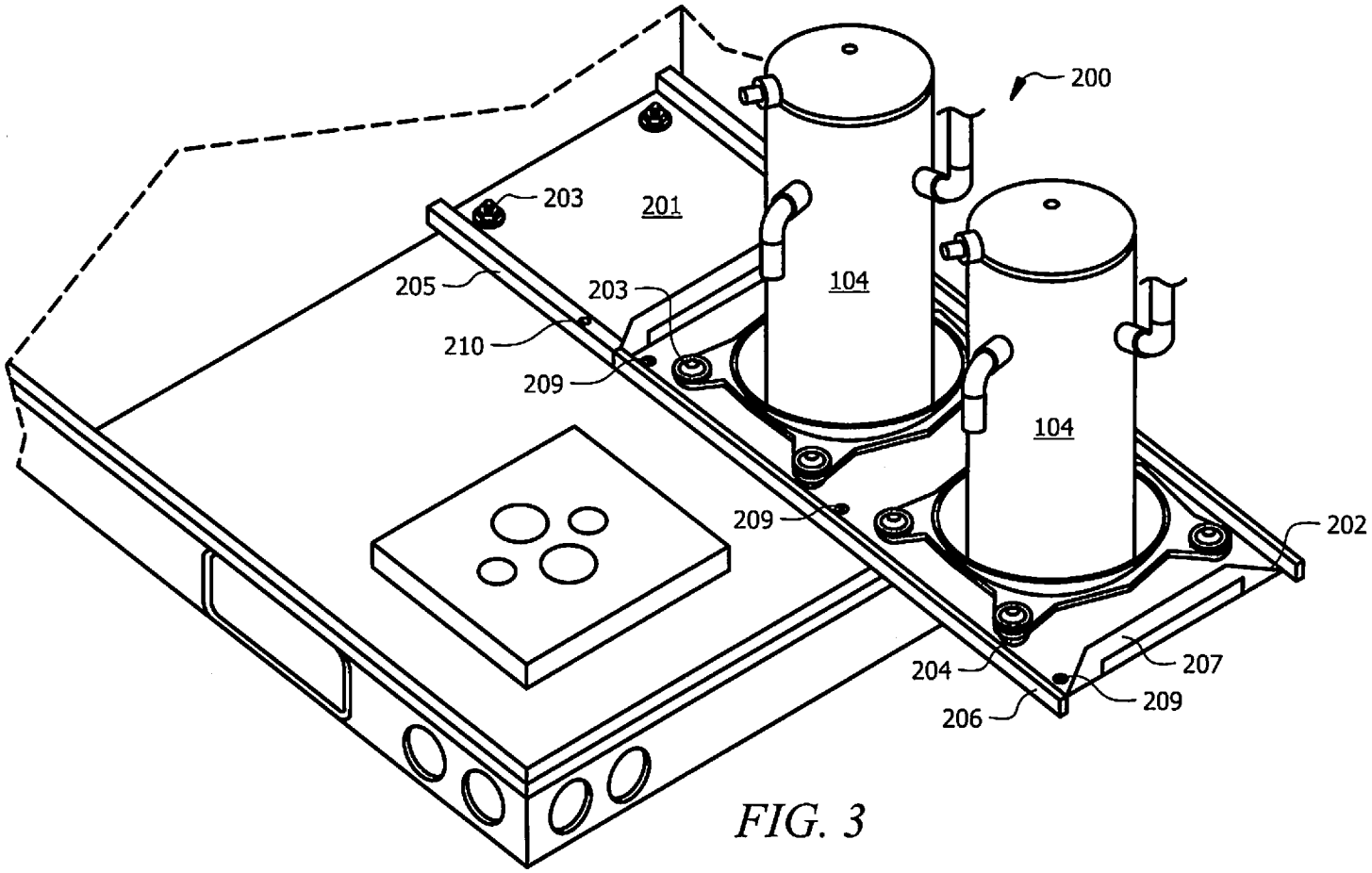
FIG. 3 is a diagram of an embodiment of the present disclosure.
Figure 4:
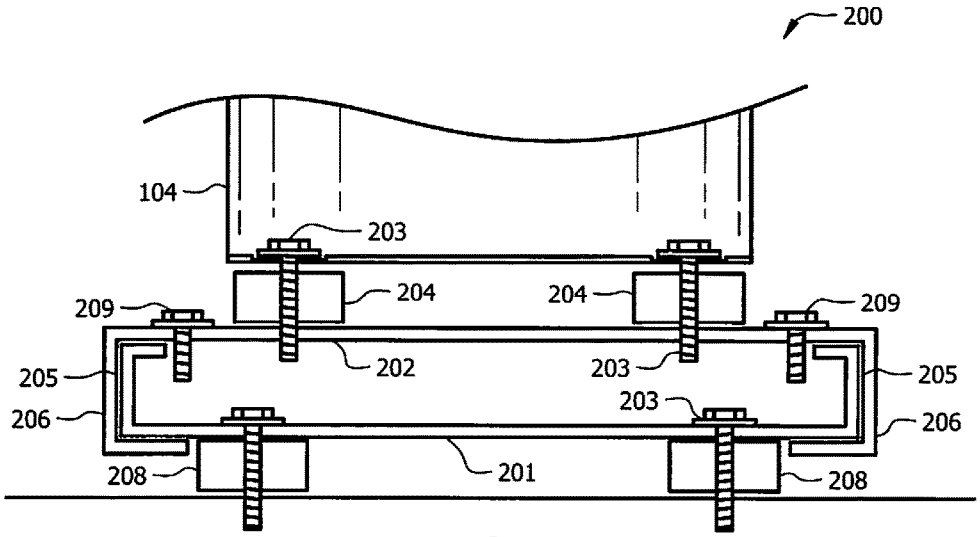
FIG. 4 is a diagram of a side view of an embodiment of the present disclosure.

Embodiments of the teachings of the present disclosure are shown in FIGS. 3 and 4. The slide rail assembly 200 may include slide rail 201, a slide plate 202, a plurality of fasteners 203 and 209, and a plurality of grommets 204 and 208. The fasteners 203 and the fasteners 209 may be screws, bolts, or other similar types of fasteners. The fasteners 203 may be used to secure the compressors to the slide plate 202 and to secure the slide rail 201 to the HVAC unit. The fasteners 209 may secure the slide plate 202 to the slide rail 201 when the slide plate is in the fully recessed position.

The grommets 204 and 208 may be annular shaped and made of rubber, metal, or other material. Grommets 204 and 208 may each have a hole for allowing a fastener 203 to pass through it. In an embodiment, a grommet 204 may be used with each fastener 203 used to secure the compressor, or compressors, to the slide plate 202. The fastener 203 may pass through each grommet 204. Additionally, in an embodiment, a grommet 208 may be used with each fastener 203 used to secure the slide rail 201 to the HVAC unit. In this arrangement, the tandem compressors 104 are not rigidly secured to the HVAC unit and are vibrationally isolated from the rest of the HVAC unit. Further, in this arrangement, the tandem compressors are rigidly attached to one another.

As shown in both FIGS. 3 and 4, slide rail 201 may be secured to the base of an HVAC unit using fasteners 203. Slide rail 201 may provide support for slide plate 202. Slide rail 201 may have a perimeter of rectangular shape. Slide rail 201 may include two raised portions 205 located on each of the longer sides (or the shorter sides in other embodiments) that make up its rectangular perimeter. Each raised portion 205 may be formed through making two approximately ninety degree upward breaks in the slide rail 201. The raised portions 205 form two small surfaces that are parallel to the flat base of slide rail 201. Each raised portion may have a plurality of holes 210 for securing the slide plate 202 to the slide rail 201 when the slide plate 202 is in the fully recessed position.

When fully recessed, slide plate 202 may be secured to slide rail 201 using a plurality of fasteners 209. Tandem compressors 104 may be secured to slide plate 202 using a plurality of fasteners 203 and grommets 204 placed between the bottom of the compressor and the top surface of the slide plate 202.

Slide plate 202 may have a rectangular perimeter with two flanges 206 located on each of the longer sides (or the shorter sides in other embodiments) that make up its rectangular perimeter. Each flange 206 may be formed by making two approximately ninety degree downward breaks along the long sides of the perimeter of slide plate 202. The slide plate 202 may be configured so that the flanges 206 fit outside and over the raised portions 205 of slide rail 201, as shown in the profile view of FIG. 3. The bottom surface of slide plate 202 may mate with the top side of the two small surfaces of raised portions 205 of the slide rail 201 allowing for sliding of the slide plate 202 over the slide rail 201.

Slide plate 202 may also have handles 207 along the shorter sides that make up its rectangular perimeter. Each handle 207 may be formed by making one approximately ninety degree upward break along the shorter sides of the perimeter of slide plate 202. Each handle 207 may further consist of a rectangular cutout allowing for the remaining material making up handle 207 to be gripped by the HVAC system maintenance person.

The slide rail assembly 200 may allow for sliding of the tandem compressors into, and out of, the HVAC unit for access by maintenance personnel. The slide rail assembly design provides for low friction sliding as the material surfaces which slide over one-another are smooth surfaces that may be made of formed sheet metal. Additionally, the placement of grommets 208 between the slide rail 201 and the HVAC unit maintain vibrational isolation of the rigidly connected tandem compressors 104 from the remainder of the HVAC unit.

Figure 5:
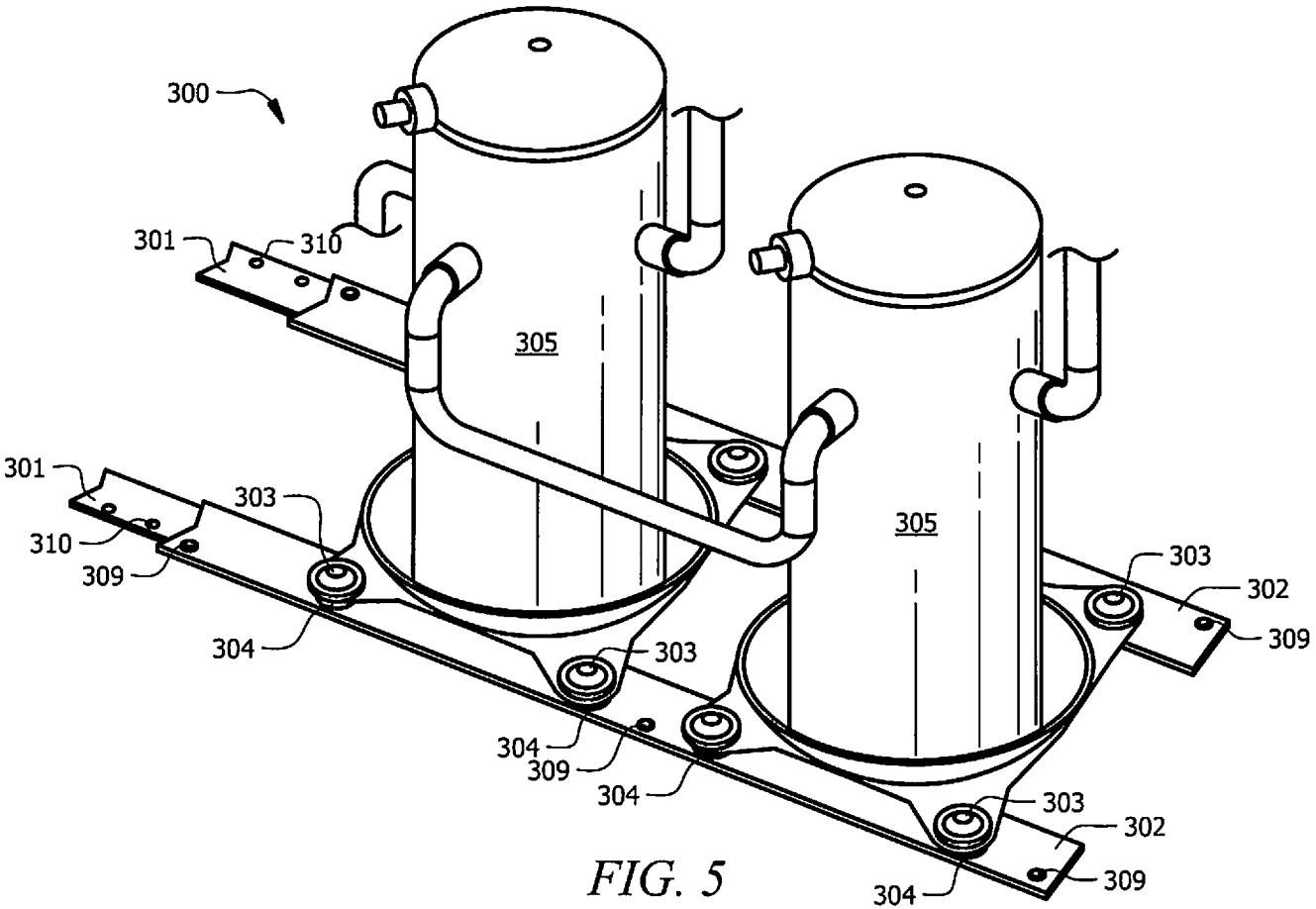
FIG. 5 is a diagram of a dual slide rail embodiment of the present disclosure.

FIG. 5 shows a dual rail embodiment of the present teachings. In this embodiment dual slide plates 302 are able to slide on dual slide rails 301. Grommets 304 and bolts 303 secure compressors 305 to slide plates 302. Fasteners 309 can attach to holes 310 when compressors 305 are slid onto slide rails 301 and in position for use within an HVAC system.

Figure 6:
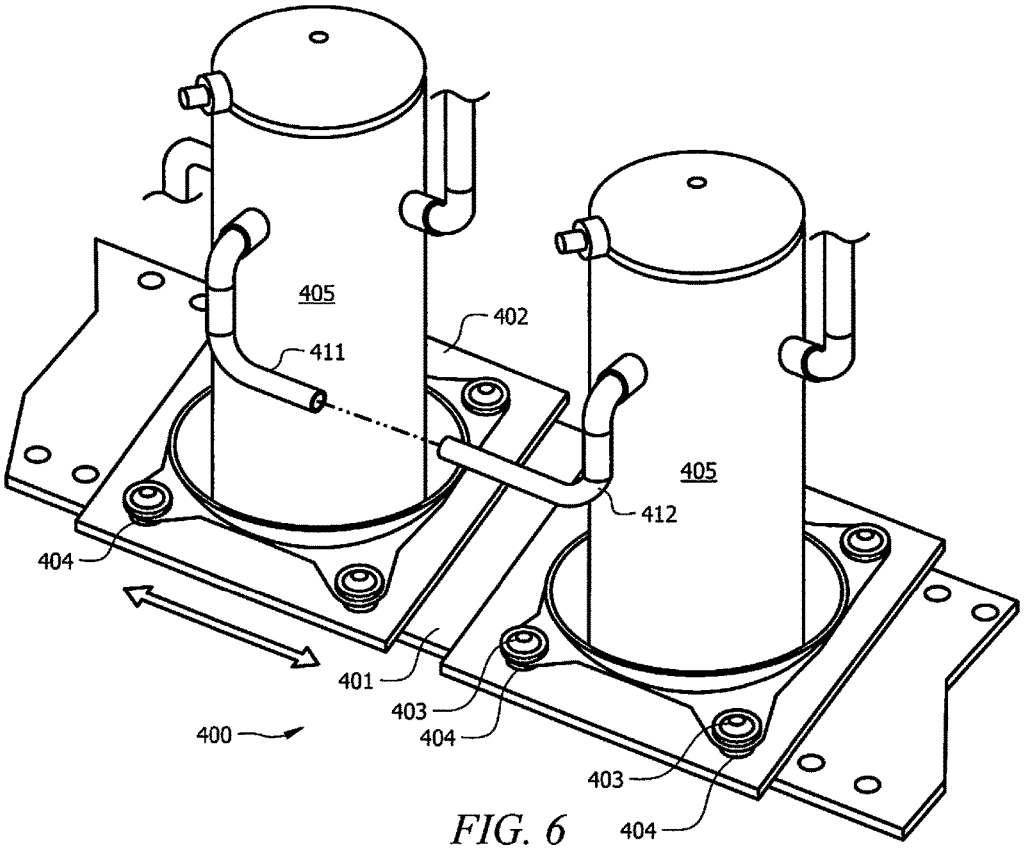
FIG. 6 is a diagram of a dual slide plate embodiment of the present disclosure.

FIG. 6 shows an embodiment of a dual slide plate embodiment of the present disclosure. In the dual slide plate system 400 each compressor 405 attaches to a separate slide plate 402. Each slide plate 402 is slidably attached to a slide rail 401 such that each slide plate 402 can move independently of the other. Compressors 405 are attached to slide plates 402 by an attachment mechanism, in the preferred embodiment a hard metal grommet 404 and bolt 403. Rubber grommets may be used to attach 401 to the HVAC system. Various attachment mechanisms and materials can be used for grommets and bolts and other parts. When servicing or repairs are performed and the slide plates 402 are used to move compressors 405, suction pipe 411 and discharge pipe 412 may need to be detached from one or both of compressors 405, especially if compressors 405 are moved in different directions along slide rail 401.

Figure 7:
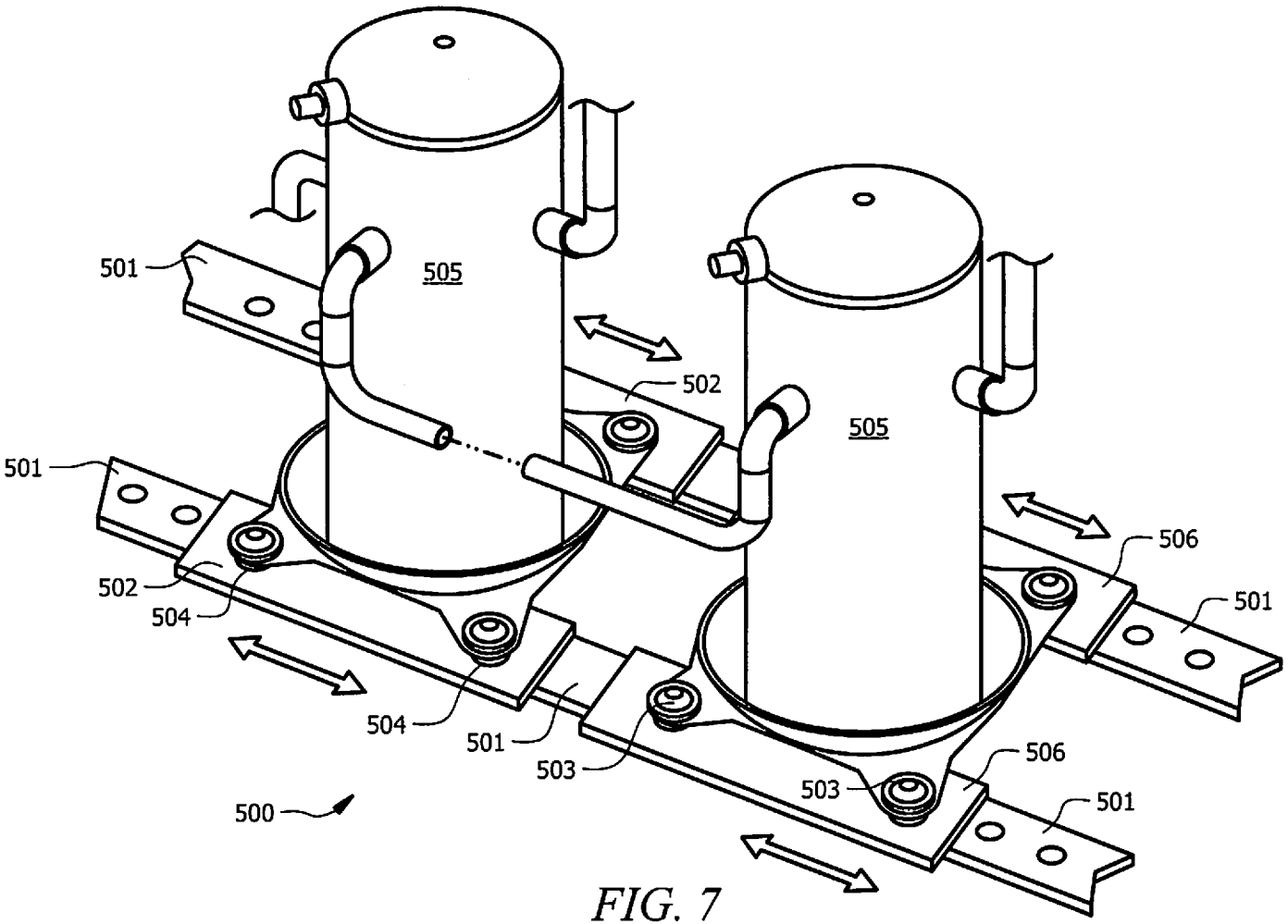
FIG. 7 is a diagram of a dual slide rail/dual slide plate embodiment of the present disclosure.

FIG. 7 shows a dual-rail/bi-directional embodiment of the present teachings. In this embodiment compressors 505 can slide independently of each other by means of slide plates 502, 506 on slide rails 501. Other connections and fasteners such as grommets 504 and bolts or screws 503 can be implemented as in other embodiments discussed elsewhere herein.

Figure 8:
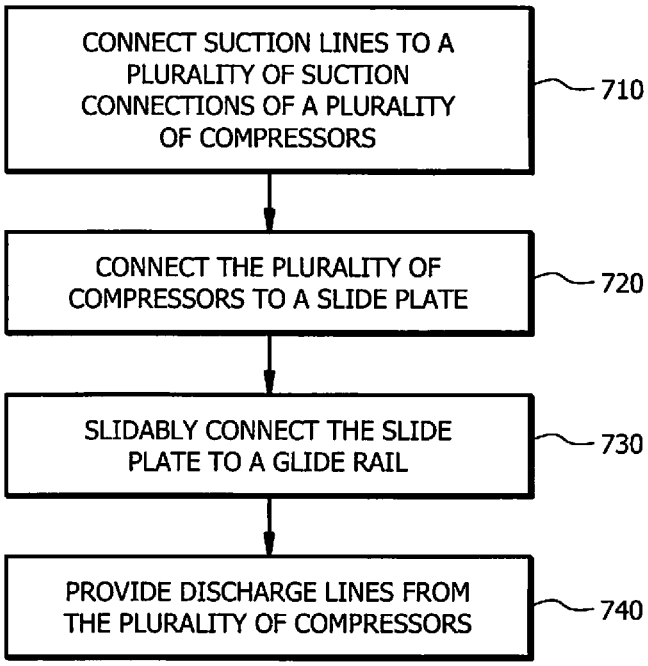
FIG. 8 is a flow chart diagram of a method of practicing the present disclosure.

FIG. 8 shows a method for constructing a tandem compressor system according to the present disclosure. The method comprises the steps of connecting a suction line to a plurality of suction portion lines connecting to a plurality of compressors 710. Each of the plurality of compressors is attached to the slide plate 720. The slide plate is slidably attached to the slide rail 730. Discharge lines are also provided from each of the compressors 740.

Figure 9:
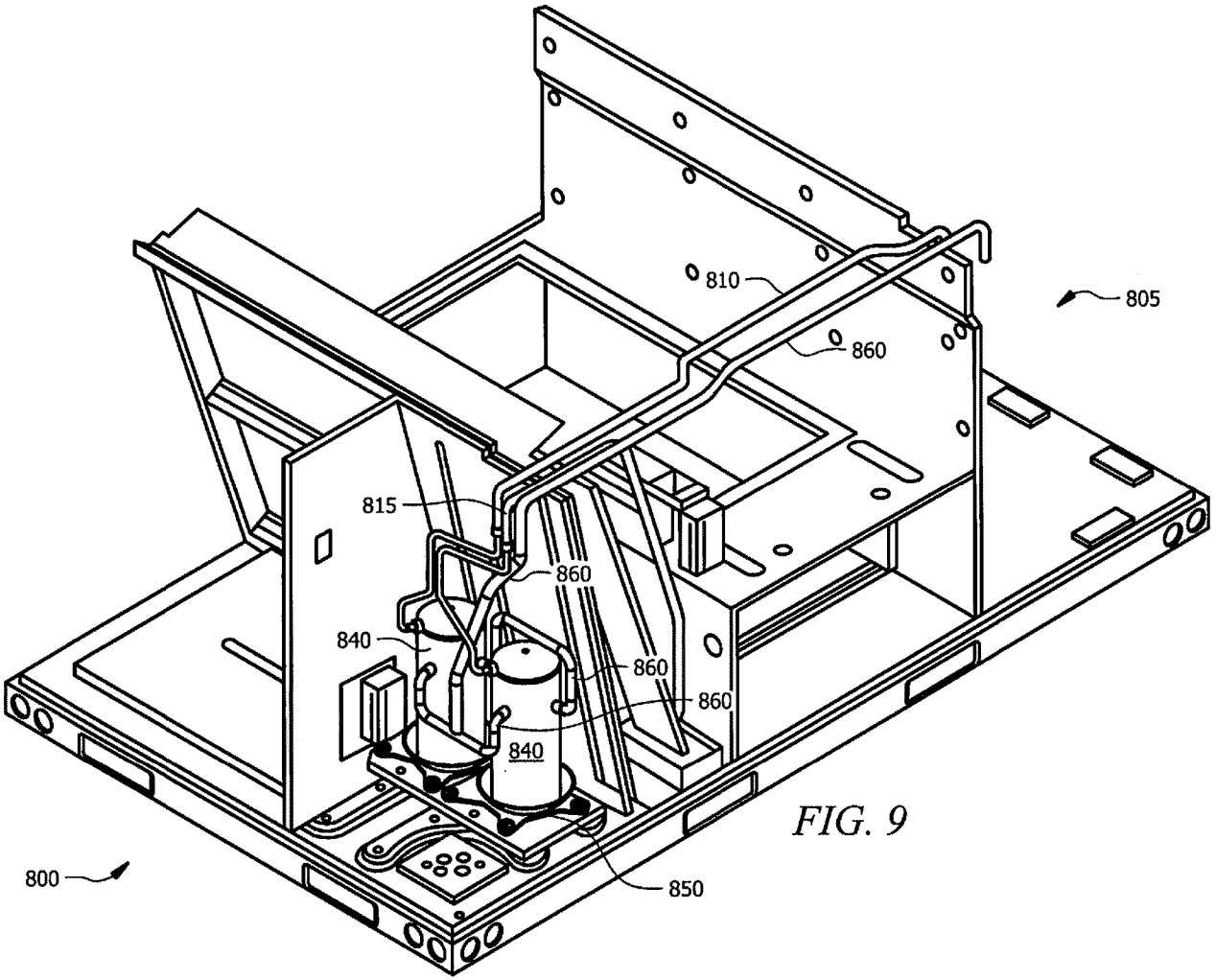
FIG. 9 is a diagram of an embodiment of an HVAC system implementing a compressor slide rail.

FIG. 9 shows an embodiment of a tandem compressor slide rail in the context of an HVAC system. As shown, HVAC system 800 comprises spaces 805, 810, 815 for HVAC machinery such as heat exchangers or recovery units. Tandem compressors 840, attached to slide plate 850, can connect to other HVAC components by means of piping 860 such as suction or discharge lines. Tandem compressors 840 and slide plate 850 allow easier access and repairs to be made within HVAC system 800.

Other embodiments can comprise three, four or more compressors in a slide rail configuration. The compressors used can be of a variety of sizes. Alternate sizes can be used within the same configuration in some embodiments.

The connections, pipes, grommets, bolts, and other fasteners used in the teachings of the present disclosure can take a variety of forms. Pipes of various materials such as aluminum, copper, or other materials can be used. Rubber grommets and bolts can attach the compressors to the slide rails, or any appropriate attachment means can be used.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An HVAC system comprising:

a slide rail mounted to the HVAC system with a first plurality of attachments, the slide rail comprising two raised portions on lateral edges of the slide rail;

a plurality of compressors fluidly coupled to at least one other component within the HVAC system; and a slide plate, the slide plate comprising a second plurality of attachments to the plurality of compressors and comprising a slidable attachment to the slide rail, the slide plate comprising two flanges on lateral edges of the slide plate, the two flanges configured to fit outside of the two raised portions, the slide plate further comprising a locking attachment operable to lock the slide plate in position with respect to the slide rail.

2. The HVAC compressor system of claim 1 wherein the first plurality of attachments and second plurality of attachments comprise rubber grommets.

3. The HVAC compressor system of claim 1 wherein the locking attachment comprises holes and fasteners.

4. The HVAC compressor system of claim 1 wherein the plurality of compressors comprises two compressors.

5. The HVAC compressor system of claim 1 further comprising a plurality of suction lines connected to the plurality of compressors.

6. The HVAC compressor system of claim 1 further comprising a plurality of discharge lines connected to the plurality of compressors.

7. The HVAC compressor system of claim 1 further comprising a connection to a heat exchanger.

8. A method of constructing an HVAC system comprising:

connecting a suction line to a plurality of compressors;

attaching each of the plurality of compressors to a slide plate with a first plurality of fasteners, the slide plate comprising two flanges on lateral edges of the slide plate;

slidably attaching the slide plate to a slide rail comprising two raised portions on lateral edges of the slide rail such that the two flanges fit outside of the two raised portions;

coupling the slide rail to the HVAC system with a second plurality of fasteners; and providing a discharge line from the plurality of compressors.

9. The method of claim 8 wherein the plurality of compressors comprises two compressors.

10. The method of claim 8 further comprising providing a third plurality of fasteners to lock the slide plate with respect to the slide rail.

* * * * *